US012016411B2

(12) United States Patent
Yoon

(10) Patent No.: US 12,016,411 B2
(45) Date of Patent: Jun. 25, 2024

(54) MECHANISM FOR VENTILATING CRACK OF BUTTOCKS

(71) Applicant: Seok Dong Yoon, Gwangju-si (KR)

(72) Inventor: Seok Dong Yoon, Gwangju-si (KR)

( * ) Notice: Subject to any disclaimer, the term of this patent is extended or adjusted under 35 U.S.C. 154(b) by 173 days.

(21) Appl. No.: 17/791,340

(22) PCT Filed: Apr. 16, 2020

(86) PCT No.: PCT/KR2020/005126
§ 371 (c)(1),
(2) Date: Nov. 1, 2022

(87) PCT Pub. No.: WO2021/141181
PCT Pub. Date: Jul. 15, 2021

(65) Prior Publication Data

US 2023/0046858 A1 Feb. 16, 2023

(30) Foreign Application Priority Data

Jan. 7, 2020 (KR) ..... 10-2020-0001821
Feb. 25, 2020 (KR) ..... 10-2020-0023159
Mar. 27, 2020 (KR) ..... 10-2020-0037871

(51) Int. Cl.
*A41D 27/28* (2006.01)
*A41B 9/00* (2006.01)

(52) U.S. Cl.
CPC ..... *A41D 27/28* (2013.01)

(58) Field of Classification Search
CPC ..... A41B 9/002; A41B 9/12; A41B 9/004; A41B 9/04; A41B 2400/20;
(Continued)

(56) References Cited

U.S. PATENT DOCUMENTS 2,534,934 A * 12/1950 Viniegra ..... A41B 9/002 2/403
3,339,208 A * 9/1967 Marbach ..... A41B 9/002 2/403
(Continued)

FOREIGN PATENT DOCUMENTS

KR 20-0191702 Y1 8/2000
KR 10-2009-0106668 A 10/2009
(Continued)

OTHER PUBLICATIONS

International Search Report for PCT/KR2020/005126 dated Oct. 5, 2020 from Korean Intellectual Property Office.

*Primary Examiner* — Robert H Muromoto, Jr.
(74) *Attorney, Agent, or Firm* — Paratus Law Group, PLLC

(57) ABSTRACT

A mechanism for ventilating the crack of buttocks, includes a ventilation frame made of elastic material, inserted along the crack of buttocks in the longitudinal direction to open the crack of buttocks. The ventilation frame includes elliptical frames in which plurality of elongated frames are disposed at intervals in an elliptical shape to form an ellipse in cross-section, and linear frames. The elongated frames are disposed across the plurality of elliptical frames at intervals along the outer circumferences of the elliptical frames, so that the plurality of elliptical frames are connected to each other.

12 Claims, 12 Drawing Sheets

(58) Field of Classification Search
CPC . A41B 2400/34; A41B 9/023; A41B 2400/60; A41B 9/00; A41B 9/001; A41B 9/02; A41B 11/14; A41B 2400/22; A41B 9/026; A41D 7/005; A41D 1/084; A41D 1/06; A41D 13/05; A41D 13/1254; A41D 27/12; A41D 27/28; A41D 7/00; A61F 13/82; B62J 1/26
See application file for complete search history.

(56) References Cited

U.S. PATENT DOCUMENTS 4,004,297 A * 1/1977 Polack ..... A41D 1/06 2/403
4,244,059 A * 1/1981 Pflaumer ..... A61K 8/19 2/400
4,412,433 A * 11/1983 Safrit ..... D04B 1/243 66/182
5,152,014 A * 10/1992 Marx ..... A41B 9/12 2/403
5,390,376 A * 2/1995 Marx ..... A41B 9/004 2/403
5,467,482 A * 11/1995 Crawford, II ..... A41D 7/005 2/400
5,832,535 A * 11/1998 Davis ..... A41B 9/002 2/400
6,067,663 A * 5/2000 Fernandez ..... A61H 19/30 2/400
6,401,250 B1 * 6/2002 McNabb ..... A41D 1/06 2/78.2
6,490,732 B1 * 12/2002 Spoke ..... A41B 9/002 2/67
6,652,025 B2 * 11/2003 Sylvester ..... B62J 1/005 297/312
6,738,988 B2 * 5/2004 Ruiter ..... A41B 9/002 2/400
6,928,665 B1 * 8/2005 Yates ..... A41D 1/084 2/466
7,240,375 B2 * 7/2007 Martz ..... A41B 9/04 604/353
7,784,466 B2 * 8/2010 Clodius-Talmadge ..... A45D 26/00 128/830
7,857,798 B2 * 12/2010 Buettner ..... A41B 9/002 604/374
7,913,694 B2 * 3/2011 Clodius-Talmadge ..... A45D 26/00 128/830
9,446,808 B2 * 9/2016 Marui ..... B62J 1/02
2005/0066408 A1 * 3/2005 Varela ..... A41D 27/12 2/69
2007/0246978 A1 * 10/2007 Yu ..... B62J 1/00 297/214
2008/0196138 A1 * 8/2008 Takeuchi ..... A41D 1/06 2/401
2014/0165272 A1 * 6/2014 Chen ..... A41D 1/084 2/466
2014/0182038 A1 * 7/2014 Hirsch ..... A41B 9/12 2/2.5
2016/0165959 A1 * 6/2016 Hayes ..... A41B 9/04 2/67
2016/0219950 A1 * 8/2016 Lucchini ..... A41D 13/05
2017/0215487 A1 * 8/2017 Chou ..... A41B 9/02
2017/0258144 A1 * 9/2017 Bardini ..... A41D 13/0556
2018/0242650 A1 * 8/2018 Chou ..... A41B 9/023
2019/0208830 A1 * 7/2019 Yoo ..... A41B 9/023

FOREIGN PATENT DOCUMENTS

KR 10-2011-0134812 A 12/2011
KR 20-0461960 Y1 8/2012
KR 10-2017-0082946 A 7/2017
WO WO-2017071539 A1 * 5/2017 ..... A41D 15/00

* cited by examiner (a)

(b)

MECHANISM FOR VENTILATING CRACK OF BUTTOCKS

CROSS-REFERENCE TO PRIOR APPLICATIONS

This application is a National Stage Patent Application of PCT International Patent Application No. PCT/KR2020/005126 (filed on Apr. 16, 2020) under 35 U.S.C. § 371, which claims priority to Korean Patent Application Nos. 10-2020-0001821 (filed on Jan. 7, 2020), 10-2020-0023159 (filed on Feb. 25, 2020), 10-2020-0037871 (filed on Mar. 27, 2020), which are all hereby incorporated by reference in their entirety.

BACKGROUND

The present invention relates to a mechanism for ventilating, and more particularly, to a mechanism for ventilating the crack of buttocks that minimizes local irritation to specific body parts such as the anus, maximizes a ventilation effect, feels less like a foreign object, and has excellent deformability, fixation, wearing feeling, and aesthetic appearance, even if the physical characteristics of users are different and varied, so that a comfortable life is possible for obese people and those who sit for long periods of time or sweat profusely.

As a prior art, functional male underwear has developed, which has excellent wearing feeling and mobility and may be ventilated to remove moisture and odor around the scrotum, thereby preventing skin diseases such as eczema and smoothing metabolism and blood circulation, improving health function (see Korean Patent Publication No. 2017-0082946).

However, as shown in FIG. 16, the above functional male underwear is stitched with a triangular mesh cloth 110 in order to form a vent at a virtual triangular position connecting the scrotum and the perineum on both sides, and a plurality of far-infrared emitters 120 are disposed on one side of the mesh cloth at predetermined intervals.

However, the above functional male underwear only considers the centralized ventilation of a specific part of the body, and does not consider the ventilation restriction caused by overlapping the crack of buttocks. In addition, since the mesh cloth 110 and the like for ventilation needs to be attached together when the underwear is made, there are problems that the manufacturing cost of the underwear increases, and the underwear needs to be discarded together when the service life of the underwear is exhausted.

As another prior art, sanitary implements for the anus have been developed that prevent eczema that may occur around the anus by removing the moisture generated in the anus, and it may prevent the surface of the sanitary tool from being damaged by friction around the anus during exercise or walking, resulting in the generation of foreign bodies (see Korean Utility Model Authorization No. 0461960).

As shown in FIG. 17, the above sanitary implementation for the anus comprises: a main body portion 10 in a streamlined shape, in which both side surfaces 12 of the main body 11 made of elastic synthetic resin are symmetrical to each other, and a convex surface 13 is formed to make the center of the both side surfaces protrude; a ventilation portion 20, having a plurality of ventilation holes 21 on both side surfaces of the main body part.

However, the above sanitary implementation for the anus is not only difficult to be fixed on a specific part of the body, but also produces unexpected side effects due to the irritation of the protrusion 15, so there is a problem that it is not suitable for ordinary people except patients with anal diseases.

SUMMARY

The present invention is proposed to solve the problems mentioned above of the prior art. The object of the present invention to provide a mechanism for ventilating the crack of buttocks: that is, the ventilation restriction caused by the partial overlap of the crack of buttocks is taken into account as a whole (open the part that is attached to both sides of the buttocks), rather than only considering concentrated ventilation of specific parts of the body, so that the foreign object is less feeling, the ventilation effect is maximized, the price is low, and its deformability, fixation, wearing feeling, and esthetic appearance are excellent, even if the physical characteristics of users are different and varied, So it can not only be stably inserted and fixed to the crack of buttocks (skin), but also can prevent unexpected side effects because it does not only apply stimulation to specific local parts, making it widely used by modern people who spend more time sitting.

In order to achieve the above object, the mechanism for ventilating the crack of buttocks of the present invention is characterized in that, comprising: a ventilation frame, made of elastic material, inserted along the length direction of the crack of buttocks to open the crack of buttocks; the ventilation frame comprises: an elliptical frame, wherein a plurality of elongated frames are disposed in an elliptical shape to form an ellipse in cross-section, and a linear frame, wherein the elongated frames are disposed across the plurality of elliptical frames at intervals along the outer circumferences of the elliptical frames, so that the plurality of elliptical frameworks are connected to each other.

The present invention is characterized in that, soft frames of soft material are used in the elliptical frames in the dispersed manner, and when worn, the soft frame is bent so that forms a gentle arc shape over the entire exterior.

The present invention is characterized in that, when divided into a plurality of frames to wear, the entire exterior of the ventilation frame is formed into a gentle arc shape.

The present invention is characterized in that, the ventilation frame is subjected to rounding treatment so that the size of the elliptical frames disposed at the both ends is gradually reduced, and the ventilation frame is inserted across the entire crack of buttocks from above the anus.

The present invention is characterized in that, an elongated hole opening is formed by cutting the elliptical frames and the linear frames, the upper and lower sides of the ventilation frame are longitudinally penetrated in an elongated hole shape, and an elongated hole opening frame is formed along the edge of the elongated hole opening.

The present invention is characterized in that, a linear opening is formed by cutting the upper and lower parts of the ventilation frame along the entire longitudinal direction, a linear opening frame is formed along the edge of the linear opening, and connecting frames for connecting the divided elliptical frames to each other are formed.

The present invention is characterized in that, the ventilation frame is subjected to the rounding treatment, so that the size of the elliptical frames disposed at the rear end is gradually reduced.

The present invention is characterized in that, it further comprises: a ventilation outer shell, which is made of fiber material, and covers the entire outside of the ventilation frame, to prevent the skin from directly contacting with the ventilation frame.

The present invention is characterized in that, the ventilation frame is inserted across the entire crack of buttocks from above the anus.

The present invention is characterized in that, the ventilation frame further comprises an elongated reinforcing frame disposed along the diagonal direction, and the ventilation outer shell is provided with a fixing component that may be detached from the underwear or is integrally formed with the underwear.

The present invention is characterized in that, it comprises a ventilation frame, which is configured as the spring form in which a long spiral shape is continuously connected along the longitudinal direction, and is curved when worn, so that the entire exterior forms a gentle arc shape, thereby be inserted along the crack of buttocks to open the crack of buttocks.

The present invention is characterized in that, it comprises a ventilation outer shell made of fiber material that covers the entire exterior of the ventilation frame described above to prevent direct skin contact with the ventilation frame.

As described above, the present invention embodied the following effects of the mechanism for ventilating the crack of buttocks.

1) Its skeleton is composed of a ventilation frame consisting of an elliptical frame and a linear frame which are elongated like umbrella ribs, so that the local irritation applied to specific body parts such as anus is minimized, and the ventilation effect is maximized.

2) According to an embodiment, when an elongated hole opening or a linear opening is further provided, the local irritation and a sense of pressure applied to specific body parts such as the anus are minimized, and the barrier-free ventilation effect is maximized.

3) According to an embodiment, the dispersed soft material may be freely deformed leftward and rightward, or be divided into a plurality of division frames which independently move leftward, rightward, forward, and backward, thereby the local irritation applied to specific body parts such as the anus is minimized, and the ventilation effect is maximized.

4) According to an embodiment, when the ventilation frame is configured as the spring form in which a long spiral shape is continuously connected along the longitudinal direction, it is not necessary to manufacture a separate mold whereby the production cost may be significantly reduced.

5) Considering that the user's crack of buttocks gradually narrows toward the coccyx, when the ventilation frame is subjected to the rounding treatment to be gradually thinned toward the coccyx, it may solve the problem that the lines are exposed due to its protrusion to the outside, so that the appearance is slimmer, and the wearing feeling is excellent.

6) When the ventilation outer shell covers the entire mechanism, since the entire crack of buttocks is inserted from right above the anus to the front, feeling as underwear, and inserted in a clamping manner, thereby feeling less like a foreign object, and wearing feeling is excellent, so that a comfortable life is possible for obese people and those who sit for long periods of time or sweat profusely.

DETAILED DESCRIPTION

Hereinafter, the preferred embodiments capable of embodying the objects of the present invention will be described in detail with reference to the accompanying drawings. When describing the present embodiment, the same names are used for the same structures, and additional descriptions thereof will be omitted.

Figure 1:
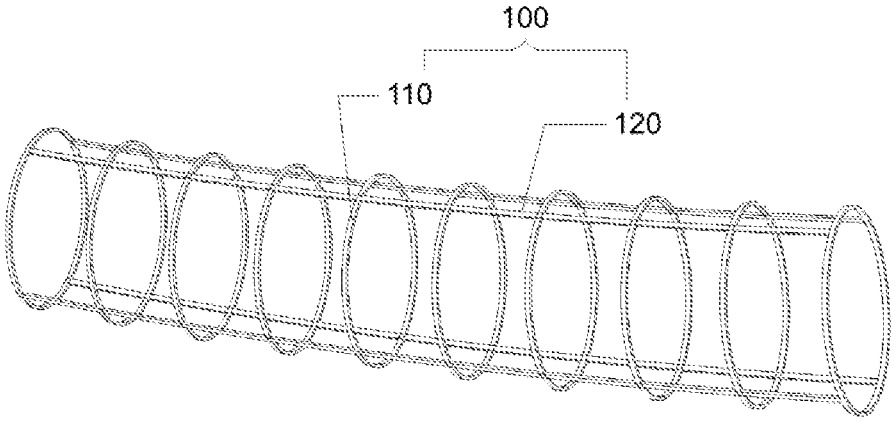
FIG. 1 is a perspective view showing a ventilation frame of a mechanism for ventilating the crack of buttocks according to the present invention.
Figure 2:
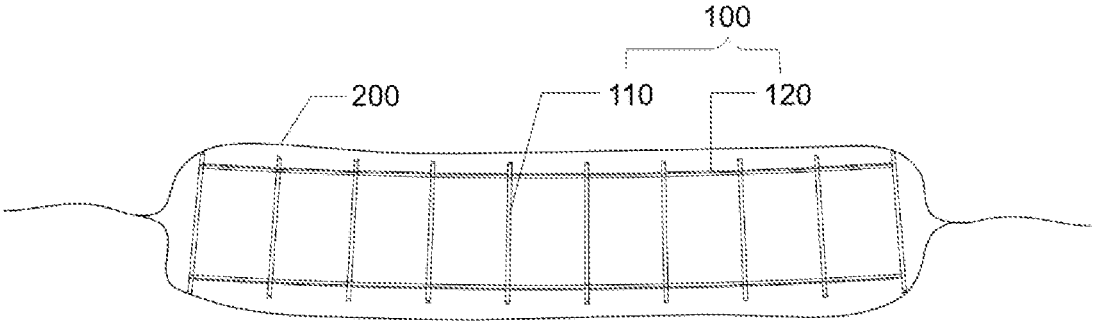
FIG. 2 is a cross-section view showing a mechanism for ventilating the crack of buttocks according to the present invention.
Figure 3:
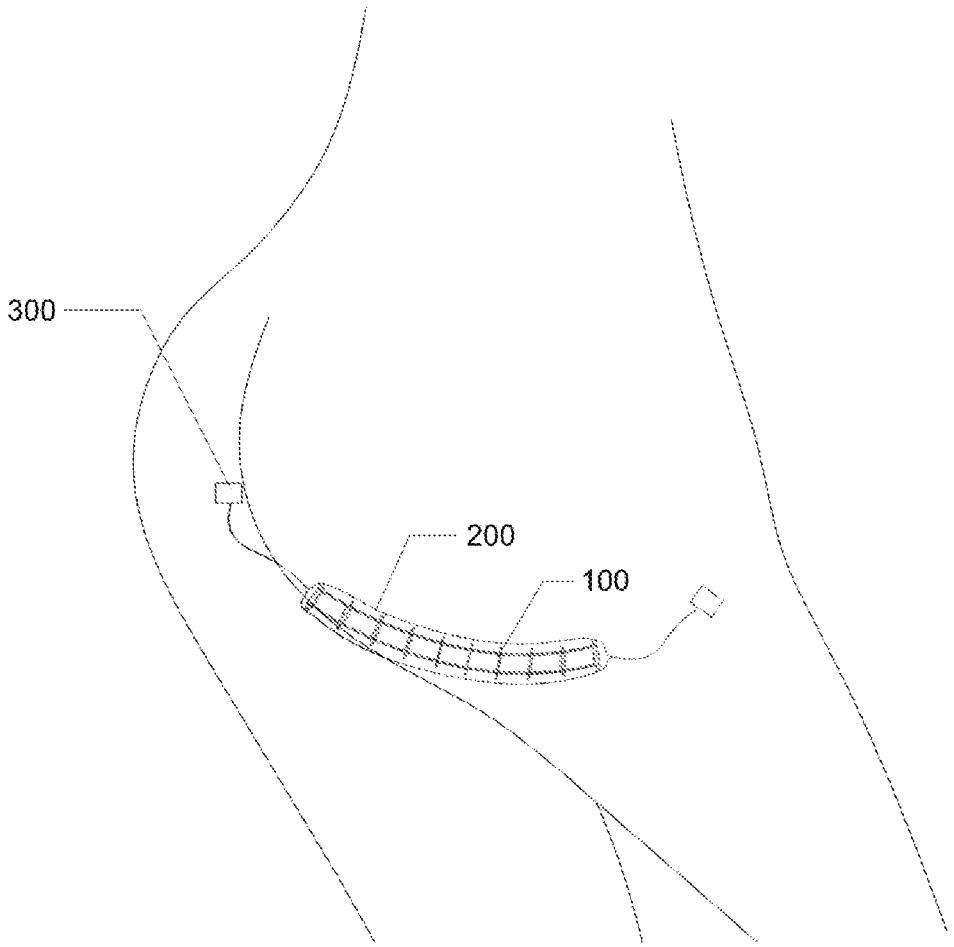
FIG. 3 is a view showing a usage state of a mechanism for ventilating the crack of buttocks according to the present invention.

FIG. 1 is a perspective view showing a ventilation frame of a mechanism for ventilating the crack of buttocks according to the present invention, FIG. 2 is a cross-section view showing a mechanism for ventilating the crack of buttocks according to the present invention, and FIG. 3 is a view showing a usage state of a mechanism for ventilating the crack of buttocks according to the present invention.

As shown in FIGS. 1-2, a mechanism for ventilating the crack of buttocks of the present invention comprises a ventilation frame 100.

The ventilation frame 100 is made of elastic synthetic resin material, including elliptical frames 110 and linear frames 120.

The elliptical frames 110 are formed by a plurality of elongated frames like umbrella ribs disposed at intervals in a substantially elliptical shape.

The linear frames 120 are configured in such a way that the elongated frames like umbrella ribs is disposed across the plurality of elliptical frames at intervals along the outer circumferences of the elliptical frames, and are slightly bent to connect the plurality of elliptical frames 110 to each other.

The ventilation frame 100 is composed of the elliptical frames 110 and the linear frames 120 to form a transverse and longitudinal frame, and at the same time, an elliptical (longitudinal) cross-section is formed, thereby the entire exterior forms a gentle arc shape.

In order to maximize the ventilation efficiency, the portions of the ventilation frame 100 except the elongated elliptical frames 110 and the linear frames 120 are formed with open spaces, and ventilation is achieved in the inner space including both ends and the outer circumferential surface.

Figure 4:
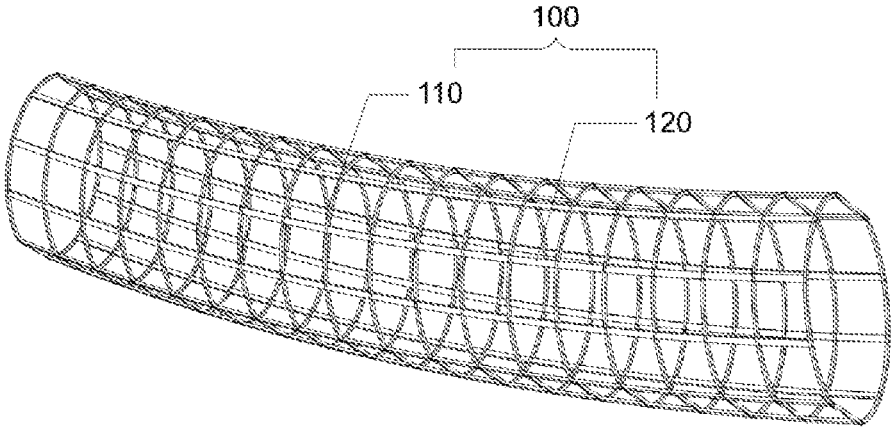
FIG. 4 is a perspective view showing a ventilation frame of a mechanism for ventilating the crack of buttocks according to additional embodiments of the present invention.

As shown in FIG. 4, of course, the elliptical frames 110 and the linear frames 120 may be increased in their spacing or number of uses according to needs in order to maintain proper elasticity and bone. (In FIG. 4, the elliptical frame 110 is implemented according to how many frames can be divided into transverse and longitudinal frames).

In addition, although not specifically shown in the figure, in order to reinforce the elliptical frames 110 and the linear frames 120, the ventilation frame 100 may also have a plurality of elongated reinforcing frames disposed along the diagonal direction.

As shown in FIG. 3, the ventilation frame 100 is inserted along the crack of buttocks (skin) in the longitudinal direction to open the crack of buttocks, at this time, in order to prevent unpredictable side effects from stimulating only specific body parts such as the anus, preferably the ventilation frame 100 is inserted across the entire crack of buttocks (in the case of men, up to before the scrotum) from above the anus.

In other words, after the ventilation frame 100 is inserted along the crack of buttocks, the lower part thereof is additionally supported by underwear such as panties (and the fixing components pulled by the rope to be described below), so that it may be stably positioned in the crack of buttocks (skin).

Also, as in the embodiment of FIG. 2, the present invention may further comprise a ventilation outer shell 200 made of fiber material that covers the entire exterior of the ventilation frame 100 to prevent the skin, i.e., crack of buttocks, from coming into direct contact with the ventilation frame 100.

The ventilation outer shell 200 may be made separately from the underwear or integrally formed with the underwear (by sewing, etc.).

The ventilation outer shell 200 is preferably a functional fiber mainly used for ventilation in underwear materials, but pure cotton or the like may also be used, so that the skin does not feel a foreign object.

In addition, the ventilation outer shell 200 may also comprise fixing components 300 attached to the underwear to maintain better the state of the crack of buttocks inserted together with the ventilation frame 100.

As the fixing components 300, various fixing means may be used, such as a snap button, a hook, loop tape (also known as Velcro), a connecting ring, etc., which apply to underwear.

Figure 5:
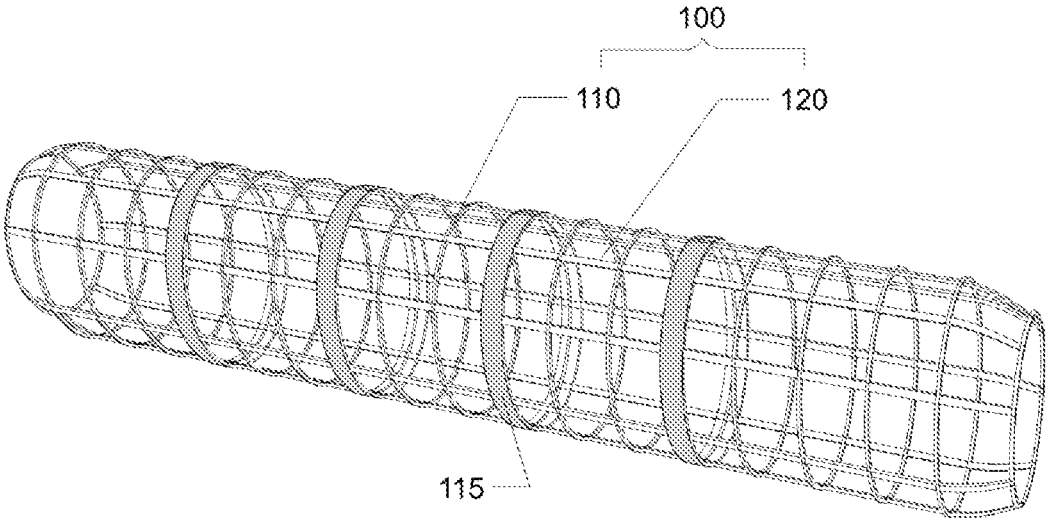
FIG. 5 is a perspective view showing a ventilation frame of a mechanism for ventilating the crack of buttocks according to another additional embodiment of the present invention.

As shown in FIG. 5, according to an additional embodiment of the present invention, a mechanism for ventilating the crack of buttocks comprises a ventilation frame 100.

The ventilation frame 100 is made of elastic synthetic resin material, including elliptical frames 110 and linear frames 120.

The elliptical frames 110 are formed by a plurality of elongated frames like umbrella ribs disposed at intervals in a substantially elliptical shape.

Soft frames 115 of synthetic resin or synthetic rubber of soft material are used in a dispersed manner in the elliptical frames, and the soft frames 115 are further freely bent leftward and rightward when worn, thereby making the entire exterior forms a gentle arc shape.

The linear frames 120 are configured in such a way that the elongated frames like umbrella ribs is disposed across the plurality of elliptical frames at intervals along the outer circumferences of the elliptical frames, to connect the plurality of elliptical frames 110 to each other.

The ventilation frame 100 is composed of the elliptical frames 110 and the linear frames 120 to form a transverse and longitudinal frame and simultaneously form an elliptical (longitudinal) cross-section.

In order to maximize the ventilation efficiency, the portions of the ventilation frame 100 except the elongated elliptical frames 110 and the linear frames 120 are controlled in open spaces, and ventilation is achieved in the inner space including both ends and the outer circumferential surface.

In order to provide a more comfortable wearing feeling, preferably, the ventilation frame 100 is subjected to the rounding treatment, whereby the size of the elliptical frames 110 disposed at both ends are gradually reduced.

Of course, the elliptical frames 110 and the linear frames 120 may be increased in their spacing or number of uses according to needs in order to maintain proper elasticity and bone.

In addition, although not specifically shown in the figure, in order to reinforce the elliptical frames 110 and the linear frames 120, the ventilation frame 100 may also have a plurality of elongated reinforcing frames disposed along the diagonal direction.

The ventilation frame 100 is inserted along the crack of buttocks (skin) in the longitudinal direction to open the crack of buttocks, at this time, in order to prevent unpredictable side effects from stimulating only specific body parts such as the anus, preferably the ventilation frame 100 is inserted across the entire crack of buttocks (in the case of men, up to before the scrotum) from above the anus.

Figure 6:
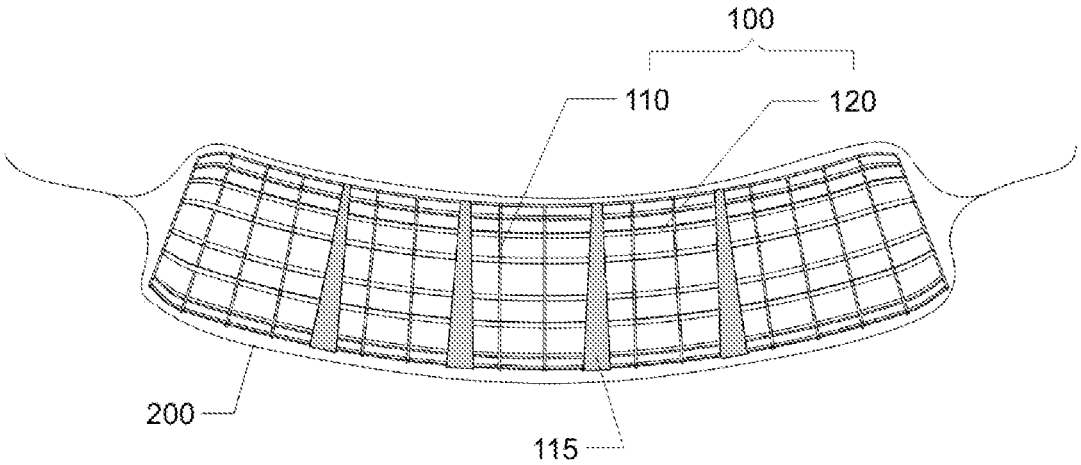
FIG. 6 is a cross-section view showing a usage state of the mechanism for ventilating the crack of buttocks according to the embodiment of FIG. 5.

Also, as an additional embodiment of the present invention, as shown in FIG. 6, it may further comprise a ventilation outer shell 200, the ventilation outer shell 200 is made of fiber material, which covers the entire exterior of the ventilation frame 100 to prevent the skin, i.e., crack of buttocks, from coming into direct contact with the ventilation frame 100.

The ventilation outer shell 200 may be made separately from the underwear, or may be made fixed to the underwear (by sewing, etc.), whereby the ventilation frame 100 may be stably positioned in the crack of buttocks (skin).

The ventilation outer shell 200 is preferably a functional fiber mainly used for ventilation in underwear materials, but pure cotton or the like may also be used, so that the skin does not feel a foreign object.

In addition, as another embodiment of the present invention, the ventilation outer shell 200 may also comprise separate fixing components (not shown) attached to the underwear to maintain better the state of the crack of buttocks inserted together with the ventilation frame 100.

Figure 7:
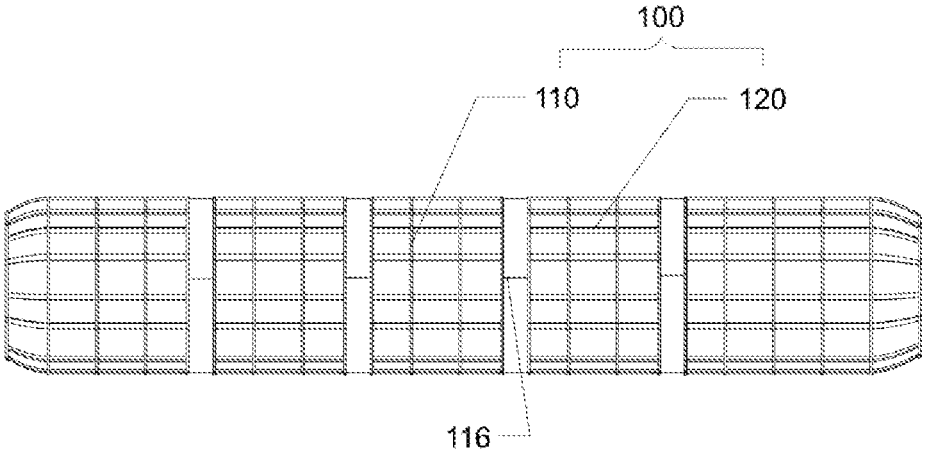
FIG. 7 is a perspective view showing a ventilation frame of a mechanism for ventilating the crack of buttocks according to an additional embodiment of the present invention.
Figure 8:
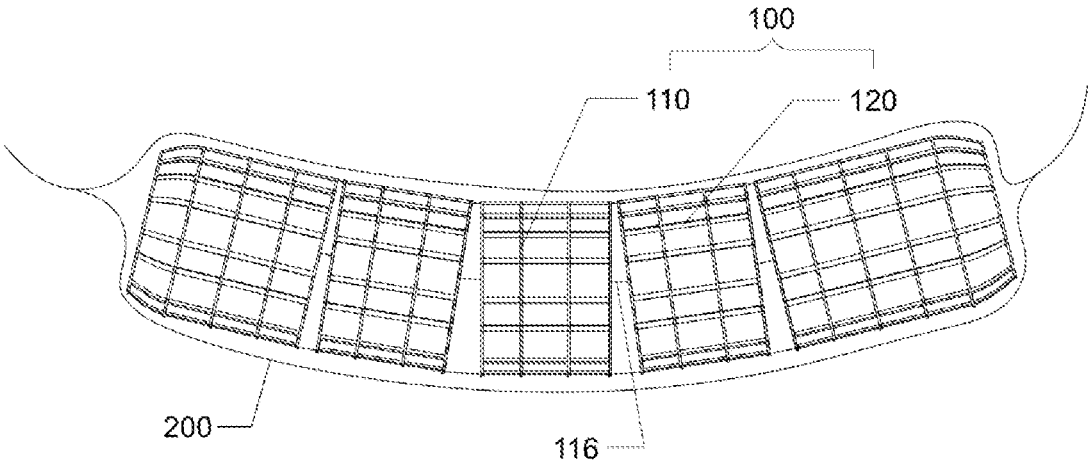
FIG. 8 is a view showing a usage state of the mechanism for ventilating the crack of buttocks according to the embodiment of FIG. 7.

At another aspect, as another embodiment of the present invention, as shown in FIG. 7 and FIG. 8, the ventilation frame 100 may be divided into (about 3-5) multiple (division) frames, when worn, which move leftward, rightward, forward, and backward to make the entire exterior naturally form a gentle arc shape.

The division frames may be in a completely separated state whereby they may move freely leftward, rightward, forward, and backward independently from each other, or may be connected by connecting components 116 such as ropes to restrict movement more than a predetermined interval.

In this embodiment, in order to provide a more comfortable wearing feeling, also preferably, the ventilation frame 100 is subjected to the rounding treatment, whereby the size of the division frames of the elliptical frames 110 disposed at both ends are gradually reduced.

Figure 9:
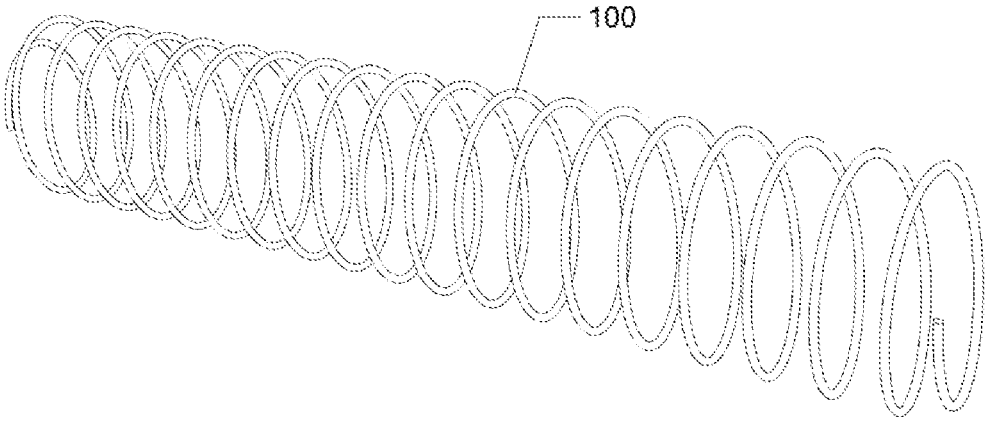
FIG. 9 is a perspective view showing a ventilation frame of a mechanism for ventilating the crack of buttocks according to an additional embodiment of the present invention.
Figure 10:
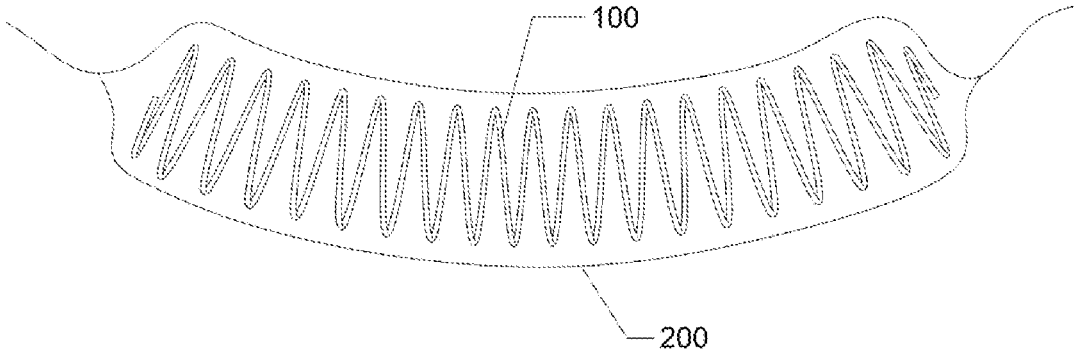
FIG. 10 is a view showing a usage state of the mechanism for ventilating the crack of buttocks according to the embodiment of FIG. 9.

At another aspect, as another embodiment of the present invention, as shown in FIG. 9 and FIG. 10, the ventilation frame 100 may be configured as the spring form in which a long spiral shape is continuously connected. In this case, even without making additional molds, the size and elasticity of the ventilation frame 100 may be adjusted, reducing the production cost significantly.

Figure 11:
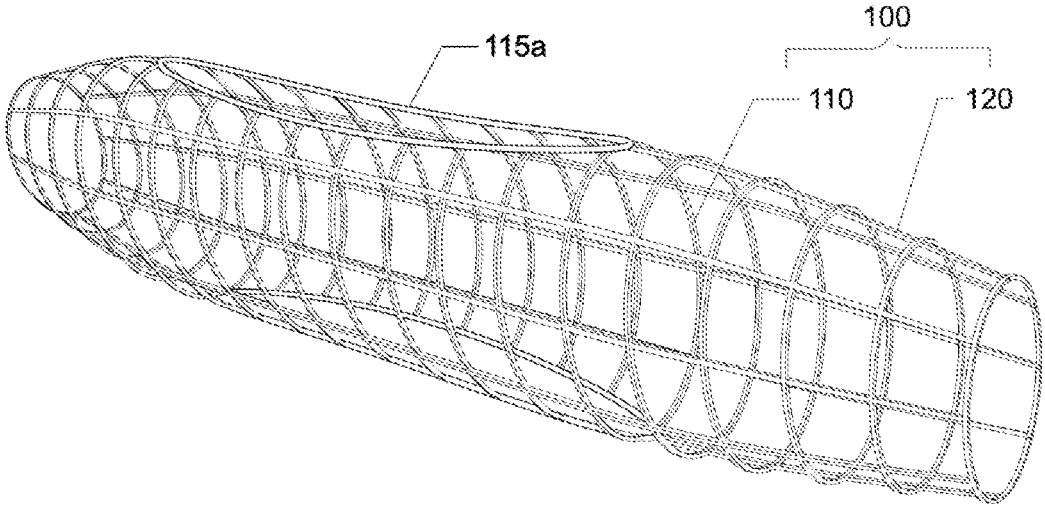
FIG. 11 is a perspective view showing a ventilation frame of a mechanism for ventilating the crack of buttocks according to another additional embodiment of the present invention.
Figure 12:
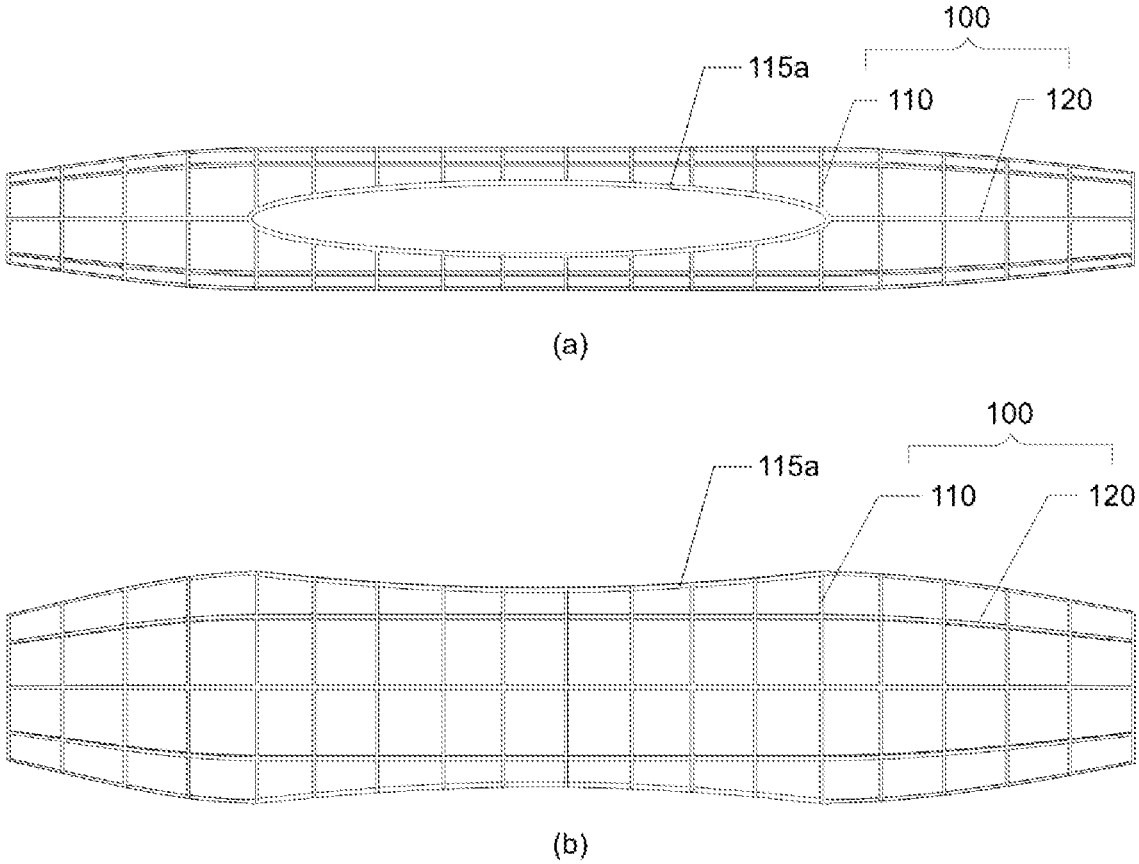
FIG. 12 is a plan view portion (a) and a cross-sectional view portion (b) showing the mechanism for ventilating the crack of buttocks according to the embodiment according to FIG. 11.

As shown in FIG. 11 and FIGS. 12, according to additional embodiments of the present invention, a mechanism for ventilating the crack of buttocks comprises a ventilation frame 100.

The linear frames 120 are configured in such a way that the elongated frames like umbrella ribs is disposed across the plurality of elliptical frames at intervals along the outer circumferences of the elliptical frames, to connect the plurality of elliptical frames 110 to each other.

The ventilation frame 100 is composed of the elliptical frames 110 and the linear frames 120 to form a transverse and longitudinal frame and simultaneously form an elliptical (longitudinal) cross-section.

In order to maximize the ventilation efficiency, the portions of the ventilation frame 100 except the elongated elliptical frames 110 and the linear frames 120 are controlled in open spaces, and ventilation is achieved in the inner space including both ends and the outer circumferential surface.

Wherein, by cutting the elliptical frames 110 and the linear frames 120, an elongated hole opening is formed on the upper and lower sides, respectively, and a substantially elliptical-shaped long-hole longitudinally penetrates the upper and lower sides of the ventilation frame 100, and an elongated hole opening frame 115*a* is formed along the edge of the elongated hole opening.

The elongated hole opening may reduce the direct contact with specific main parts such as the anus, thereby reducing the feeling of foreign object or the sense of pressure, improving the wearing feeling, and realizing smooth ventilation.

Considering that the user's crack of buttocks gradually narrows toward the coccyx, in order to provide a comfortable wearing feeling, preferably, the ventilation frame 100 is subjected to the rounding treatment, so that the size of the elliptical frames 110 disposed at the rear end (user's coccyx side) is gradually reduced.

Of course, in order to provide a more comfortable wearing feeling, the ventilation frame 100 may be subjected to the rounding treatment, whereby the size of the elliptical frames 110 disposed at the front and rear ends are gradually reduced.

Of course, the elliptical frames 110 and the linear frames 120 may be increased in their spacing or number of uses according to needs in order to maintain proper elasticity and bone.

In addition, although not specifically shown in the figure, in order to reinforce the elliptical frames 110 and the linear frames 120, the ventilation frame 100 may also have a plurality of elongated reinforcing frames disposed along the diagonal direction.

The ventilation frame 100 is inserted along the crack of buttocks (skin) in the longitudinal direction to open the crack of buttocks, at this time, in order to prevent unpredictable side effects from stimulating only specific body parts such as the anus, the ventilation frame 100 is inserted across the entire crack of buttocks (in the case of men, up to before the scrotum) from above the anus.

Figure 15:
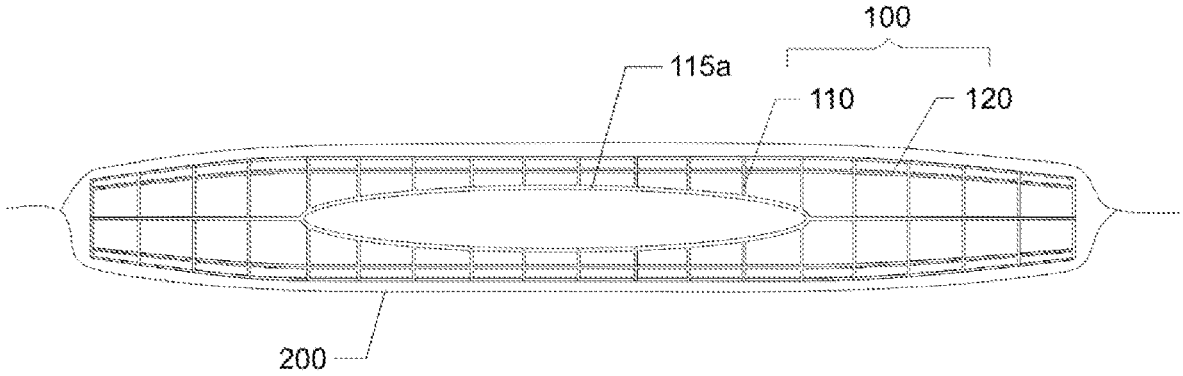
FIG. 15 is a plan view showing a usage state of a ventilation frame of a mechanism for ventilating the crack of buttocks according to another embodiment of the present invention.
Figure 16:
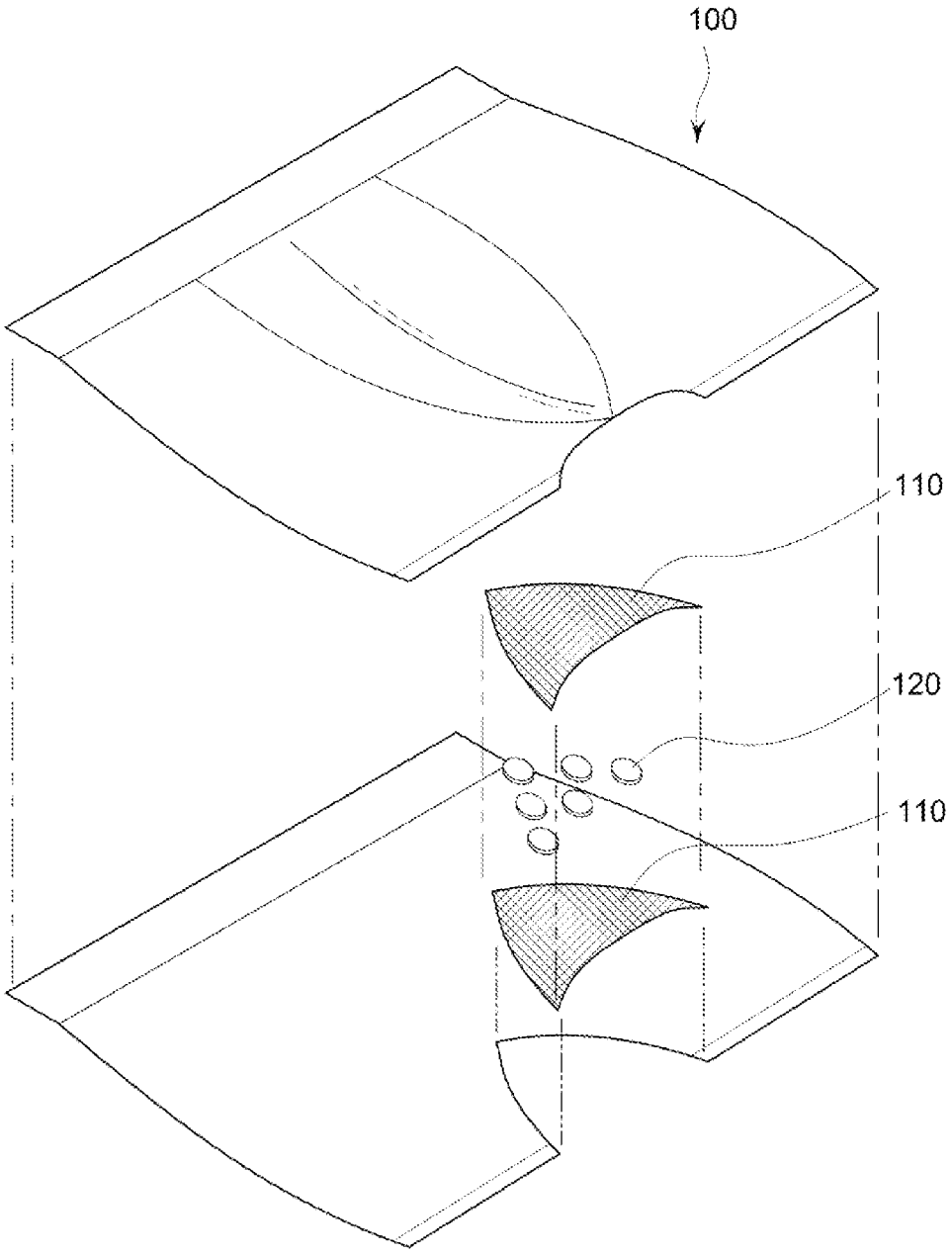
FIG. 16 is a view showing a breathable underwear band according to the prior art.
Figure 17:
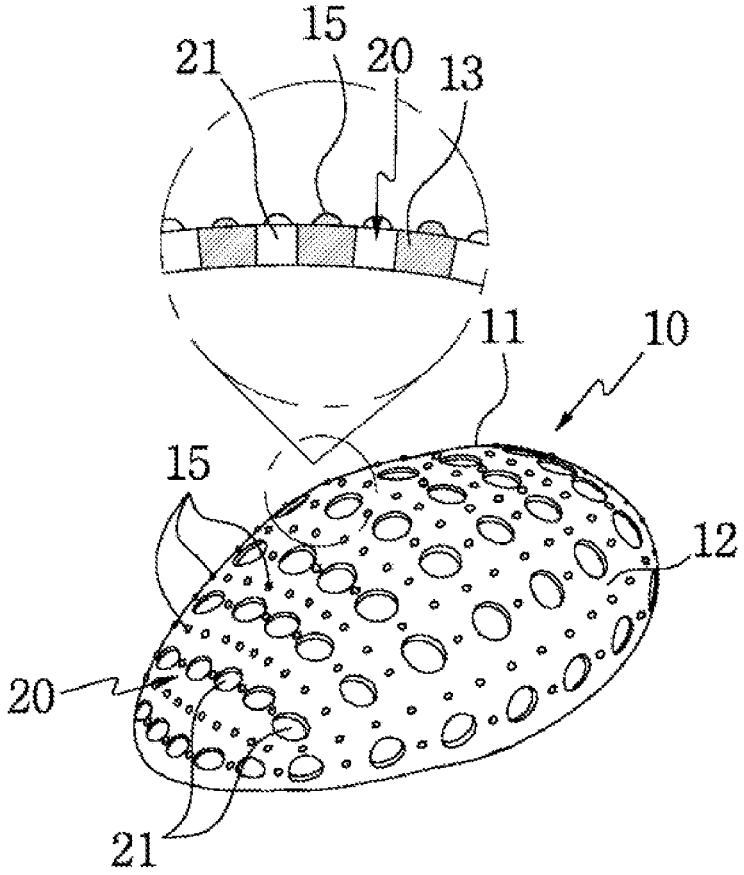
FIG. 17 is a view showing a sanitary implement for the anus according to the prior art anus.

Also, as shown in FIG. 15, it may father comprise a ventilation outer shell 200, the ventilation outer shell 200 is made of fiber material, which covers the entire exterior of the ventilation frame 100 to prevent the skin, i.e., crack of buttocks, from coming into direct contact with the ventilation frame 100.

The ventilation outer shell 200 may be made separately from the underwear, or may be made fixed to the underwear (by sewing, etc.), whereby the ventilation frame 100 may be stably positioned in the crack of buttocks (skin).

The ventilation outer shell 200 is preferably a functional fiber mainly used for ventilation in underwear materials, but pure cotton or the like may also be used, so that the skin does not feel a foreign object.

In addition, as another embodiment of the present invention, the ventilation outer shell 200 may also comprise separate fixing components (not shown) attached to the underwear to maintain better the state of the crack of buttocks inserted together with the ventilation frame 100.

In addition, as another embodiment of the present invention, connecting components such as connecting rings may also be provided at both ends of the ventilation frame 100 for connecting with underwear and the like using a rope and the like.

Figure 13:
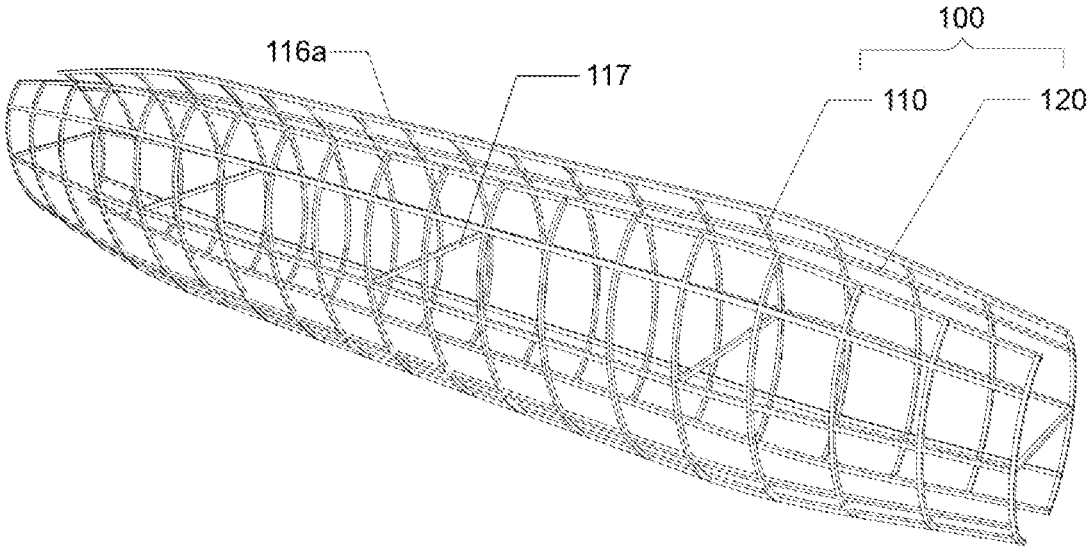
FIG. 13 is a perspective view showing a ventilation frame of a mechanism for ventilating the crack of buttocks according to an additional embodiment of the present invention.
Figure 14:
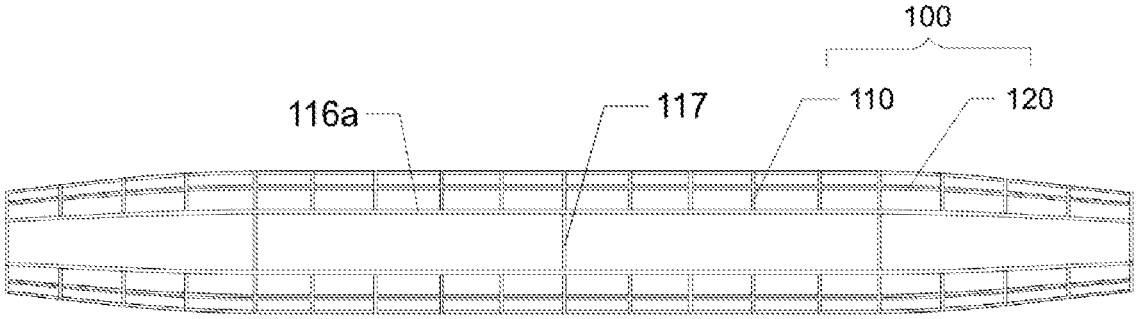
FIG. 14 is a plan view portion (a) and a cross-sectional view portion (b) showing the mechanism for ventilating the crack of buttocks that illustrates the embodiment of FIG. 13.
Figure 14:
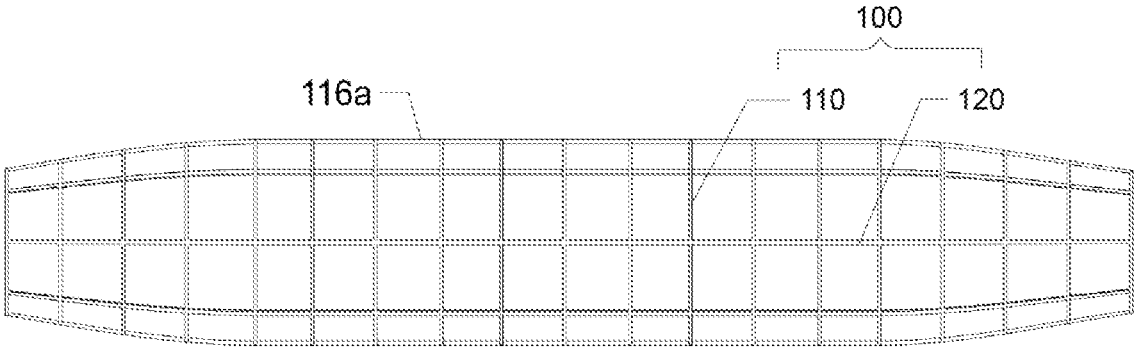

In addition, as another embodiment of the present invention, as shown in FIGS. 13 and 14, the ventilation frame 100 may not form the elongated hole opening frame 115*a*, but a linear opening may be formed by cutting the upper and lower parts of the ventilation frame 100 along the entire longitudinal direction, and the linear opening frame 116*a* may be formed along the edge of the linear opening.

At this time, in order to connect the elliptical frames 100 divided by the linear opening to each other, connecting frames 117 connecting the center portions of the opposed divided elliptical frames 100 are formed, and the connecting frames 117 may be formed on the entire elliptical frames 100, or may be disposed at intervals in a dispersed manner as shown in the figure.

Even in the case of having such a linear opening frame 116*a*, it is possible to reduce the direct contact with a specific main part such as the anus, thereby reducing the feeling of foreign objects or the sense of pressure, improving the wearing feeling, and realizing smooth ventilation.

In this embodiment, considering that the crack of buttocks of the user gradually narrows toward the coccyx, in order to provide a more comfortable wearing feeling, also preferably, the ventilation frame 100 is subjected to the rounding treatment, whereby the size of the elliptical frames 110 disposed at the front and the rear end (user's coccyx side) is gradually reduced.

Also, in such embodiment, it may further comprise a ventilation outer shell 200, the ventilation outer shell 200 is made of fiber material, which covers the entire exterior of the ventilation frame 100 to prevent the skin, i.e., crack of buttocks, from coming into direct contact with the ventilation frame 100.

As described herein, the skeleton of the mechanism for ventilating the crack of buttocks of the present invention is composed of a ventilation frame 100 consisting of the elongated elliptical frames 110 which are elongated like umbrella ribs and the linear frames 120, thereby minimizing irritation to specific body parts such as anus, and maximizing ventilation effect.

In addition, entire mechanism is covered by the ventilation outer shell 200 and inserted in a gentle arc shape along the entire crack of buttocks from right above the anus to the front in a clamping manner, thereby feels less like a foreign object and fixation is excellent, so that a comfortable life is possible for obese people and those who sit for long periods of time or sweat profusely.

In particular, since soft material of different properties are disposed in a dispersed manner, they may be freely deformed leftward and rightward, and the division frames that are split into multiples may move further leftward, rightward, forward, and backward independently, even if the user's physical conditions are different, it may provide a more comfortable wearing feeling according to the curve of the human body.

In particular, the ventilation frame 100 is configured with an elongated hole opening or a linear opening, which can reduce the contact with sensitive parts such as the anus, even if the user's physical conditions are different, whereby maximizing the sense of ventilation, when worn, it may provide a more comfortable wearing feeling according to the curve of the human body.

Also, when the ventilation frame is subjected to the rounding treatment to be gradually thinned toward the coccyx, it may solve the problem that the lines are exposed due to its protrusion to the outside, so that the appearance is slimmer.

In other words, natural ventilation may be achieved by forcibly opening the crack of buttocks (skin), including the anus, so that secretions, sweat or moisture from the crack of buttocks are naturally ventilated and dried. Therefore, the prevention and improvement of anal diseases such as pruritus ani can also be expected.

Herein, preferred embodiments according to the present invention are illustrated. In addition to the embodiments described above, it is apparent to those skills in the art that the present invention may be embodied in other specific forms without departing from the spirit or scope of the present invention.

Therefore, the described above embodiments are to be considered illustrative rather than restrictive, and accordingly, the present invention is not limited to the above description but may be modified within the scope of the appended claims and their equivalents.

The mechanism for ventilating the crack of buttocks of the present invention, as described above, has the following industrial advantages: even if the local irritation and the sense of pressure applied to specific body parts such as the anus are minimized, the barrier-free ventilation effect is maximized, and the problem that lines are exposed due to its protrusion to the outside can be solved. So that the appearance is slenderer and the wearing feeling is excellent. Since the entire crack of buttocks is inserted in a gentle arc shape along the entire crack of buttocks from right above the anus to the front in a clamping manner, thereby feels less like a foreign object and fixation is excellent, so that a comfortable life is possible for obese people and those who sit for long periods of time or sweat profusely.

The invention claimed is:

1. A mechanism for ventilating the crack of buttocks, characterized in that it comprises:

a ventilation frame made of elastic material, inserted along the crack of buttocks in the longitudinal direction to open the crack of buttocks;

the ventilation frame comprises:

elliptical frames, wherein a plurality of elongated frames are disposed at intervals in an elliptical shape to form an ellipse in cross-section, and linear frames, wherein the elongated frames are disposed across the plurality of elliptical frames at intervals along the outer circumferences of the elliptical frames, so that the plurality of elliptical frames are connected to each other.

2. The mechanism for ventilating the crack of buttocks according to claim 1, characterized in that soft frames of softer material are used in the elliptical frames in the dispersed manner, and when worn, the soft frames are bent so that the entire exterior forms a gentle arc shape.

3. The mechanism for ventilating the crack of buttocks according to claim 1, characterized in that when the ventilation frame is worn by being divided into a plurality of frames, the entire exterior has a gentle arc shape.

4. The mechanism for ventilating the crack of buttocks according to claim 2, characterized in that the ventilation frame is subjected to rounding treatment so that the size of the elliptical frame disposed at the both ends is gradually reduced, and the ventilation frame is inserted across the entire crack of buttocks from above the anus.

5. The mechanism for ventilating the crack of buttocks according to claim 1, characterized in that an elongated hole opening is formed by cutting the elliptical frames and the linear frames, the upper and lower sides of the ventilation frame are longitudinally penetrated in the elongated hole shape, an elongated hole opening frame is formed along the edge of the elongated hole opening.

6. The mechanism for ventilating the crack of buttocks according to claim 1, characterized in that a linear opening is formed by cutting the upper and lower parts of the ventilation frame along the entire longitudinal direction, a linear opening frame is formed along the edge of the linear opening, and connecting frames for connecting the divided elliptical frames to each other are formed.

7. The mechanism for ventilating the crack of buttocks according to claim 5, characterized in that the ventilation frame is subjected to the rounding treatment, so that the size of the elliptical frame disposed at the rear end is gradually reduced.

8. The mechanism for ventilating the crack of buttocks according to claim 1, characterized in that further comprising:

a ventilation outer shell, which is made of fiber material, and covers the entire outside of the ventilation frame, to prevent the skin from directly contacting with the ventilation frame.

9. The mechanism for ventilating the crack of buttocks according to claim 1, characterized in that the ventilation frame is inserted across the entire crack of buttocks from above the anus.

10. The mechanism for ventilating the crack of buttocks according to claim 1, characterized in that the ventilation frame further comprises an elongated reinforcing frame disposed along the diagonal direction, the ventilation outer shell is provided with a fixing component capable of being detached from the underwear, or the ventilation outer shell is integrally formed with the underwear.

11. The mechanism for ventilating the crack of buttocks according to claim 3, characterized in that the ventilation frame is subjected to rounding treatment so that the size of the elliptical frame disposed at the both ends is gradually reduced, and the ventilation frame is inserted across the entire crack of buttocks from above the anus.

12. The mechanism for ventilating the crack of buttocks according to claim 6, characterized in that the ventilation frame is subjected to the rounding treatment, so that the size of the elliptical frame disposed at the rear end is gradually reduced.

* * * * *